US006173888B1

(12) United States Patent
Fabel

(10) Patent No.: US 6,173,888 B1
(45) Date of Patent: Jan. 16, 2001

(54) MAILING FORM FOR NON-IMPACT PRINTING

(75) Inventor: Warren M. Fabel, Delray Beach, FL (US)

(73) Assignee: Laser Substrates, Inc., Boca Raton, FL (US)

( * ) Notice: Under 35 U.S.C. 154(b), the term of this patent shall be extended for 0 days.

(21) Appl. No.: 09/243,003

(22) Filed: Feb. 2, 1999

Related U.S. Application Data

(60) Continuation-in-part of application No. 08/480,161, filed on Jun. 7, 1995, now Pat. No. 5,865,717, which is a division of application No. 08/240,869, filed on May 10, 1994, now abandoned, and a continuation-in-part of application No. 09/132,036, filed on Aug. 11, 1998, which is a continuation-in-part of application No. 08/434,416, filed on May 3, 1995, now Pat. No. 5,791,553.

(51) Int. Cl.[7] ..... B65D 27/04
(52) U.S. Cl. ..... 229/71; 229/304; 229/305
(58) Field of Search ..... 229/301, 303, 229/304, 305, 92.1, 92.3, 80.5, 71, 69

(56) References Cited

U.S. PATENT DOCUMENTS

| | | | | |
|---|---|---|---|---|
| 3,507,519 | * | 4/1970 | McNabb | 229/305 X |
| 3,941,308 | | 3/1976 | DiGirolomo et al. . | |
| 3,952,942 | * | 4/1976 | O'Leary et al. | 229/305 X |
| 4,148,430 | * | 4/1979 | Drake | 229/304 X |
| 4,384,670 | * | 5/1983 | Dicker | 229/305 X |
| 4,418,865 | * | 12/1983 | Bowen | 229/69 |
| 4,543,071 | | 9/1985 | Stenner . | |
| 4,955,526 | * | 9/1990 | Haase et al. | 229/80.5 X |
| 5,104,036 | * | 4/1992 | Rutkowski et al. | 229/301 |
| 5,238,182 | * | 8/1993 | Loch | 229/304 |
| 5,328,092 | * | 7/1994 | File | 229/303 X |
| 5,452,851 | * | 9/1995 | Albert et al. | 229/305 X |
| 5,458,273 | * | 10/1995 | Schubert et al. | 229/304 |
| 5,607,738 | * | 3/1997 | Bishop | 229/92.3 X |
| 5,633,071 | | 5/1997 | Murphy . | |
| 5,791,553 | * | 8/1998 | Fabel | 229/92.3 X |
| 5,836,622 | * | 11/1998 | Fabel | 283/62 |
| 5,865,717 | * | 2/1999 | Fabel | 493/216 |

* cited by examiner

*Primary Examiner*—Jes F. Pascua
(74) *Attorney, Agent, or Firm*—Ted W. Whitlock

(57) ABSTRACT

A mailing form, including an upper sheet of material adhesively fastened to a lower sheet, is configured for the printing of information on a single side during passage of the form through a non-impact printer. The upper and lower sheets are fastened together permanently at one end, forming a pocket to be used as a return envelope. The portion of the upper sheet which extends away from this pocket is divided into an inner flap, on which information is printed, and an outer flap, which is temporarily fastened to the lower sheet in order to protect an adhesive pattern during the printing process. After the printing process, the outer flap is removed and discarded, the inner flap is folded along lines provided for folding, and the lower sheet is folded on itself to enclose the inner flap. As the adhesive pattern holds the lower sheet shut in this position, address and return address information printed on the inner flap is visible through apertures in the lower sheet, which forms an envelope. After receiving this envelope, the recipient separates the pocket forming a return envelope from the rest of the materials. A part of the inner flap may be returned in this return envelope, together with a check or other remittance as desired. The address and return address has been printed on this envelope during the printing step. Before the return envelope is mailed it is sealed using a flap having an adhesive disposed thereon. Other embodiments of the form comprising a window for viewing postal indicia are also described.

19 Claims, 14 Drawing Sheets

MAILING FORM FOR NON-IMPACT PRINTING

CROSS-REFERENCE TO RELATED APPLICATIONS

This is a continuation-in-part of U.S. patent application Ser. No. 08/480,161, issued Jun. 7, 1995, as U.S. Pat. No. 5,865,717, which is a division of Ser. No. 08/240,869, filed May 10, 1994, now abandoned; and a continuation-in-part of U.S. patent application Ser. No. 09/132,036, filed Aug. 11, 1998, which is a continuation-in-part of U.S. patent application Ser. No. 08/434,416, issued May 3, 1995, as U.S. Pat. No. 5,791,553.

BACKGROUND OF THE INVENTION

1. Field of the Invention

This invention related to mailing forms, and more particularly, to mailing forms which can be folded into initial envelopes after information is printed with a non-impact printer.

2. Background of the Invention

Non-impact printers, such as laser or ink jet printers, are being increasingly used to provide a fast, economical, and convenient method of printing data developed within computer systems and stored in databases. An important example of this kind of data is found in the accounts receivable data of both large and small organizations. In most organizations, preparing and distributing monthly statements represents a significant effort, as account data is printed and distributed in envelopes.

Many invoices, monthly statements, renewal notices, questionnaires and the like arrive in a single envelope together with a number of other printed documents. At a typical minimum level, a return envelope and a response document are included with the mailing. While responses may all be returned to a central location, it is often desirable to provide a number of different locations, or box numbers, to which responses for various different mailings are sent. In this way, an initial sorting step can be avoided.

Multi-part forms, including envelopes in which statements are sent, together with the statements themselves, have been manufactured for use in impact printers. Such forms are typically assembled into webs with sprocket holes extending along one or both lateral edges to facilitate handling through a pin feed impact printer. Transferable coatings are selectively placed on one or more of the sheets making up the assembly, so that externally applied printing forces are transferred to produce characters on intermediate document surfaces. This approach has further been modified to provide a remittance envelope, in which various materials, such as a check and a portion of the statement, may be returned to the organization sending the statement.

However, with the increasing popularity of non-impact printers, especially with small organizations, the percentage of organizations having the impact printers necessary to use such multi-part forms is decreasing. Therefore, what is needed is a mailing form configured for use with non-impact printers. However, such forms do not have flexibility and capability of forms developed for use with ink jet printers. Furthermore, such forms often must be processed through automatic folding/sealing machines to be used in a practical manner. Such automatic folding machines are other examples of equipment not available to many small organizations. Therefore, what is needed is a mailing form which can be easily prepared without the use of a folding machine.

Mailing forms developed for use in non-impact printers, require that some information be printed on each side of the form if a return envelope is to be constructed from the form. Because of practical considerations, dual side printing generally means that fixed data, which is the same for all of the forms being printed, must be printed on one side while variable data, which is generally specific for each form being printed, is printed on the other side. For example, the front of the return envelope is printed with fixed data on one side of the form. In this way, the customer returning the return envelope is required to fill out his address. This compromise may present an inconvenience for the organization originally sending the mailing forms as well as for the customer. If the address of the organization must be printed as part of the fixed information on the return envelope, a special box number related to the particular form cannot be used. Thus, what is needed is a mailing form that can be used to produce an initial envelope, a return envelope, and a statement by printing on one side only of the form.

A number of different types of forms include flaps or pockets provided in a closed configuration which must be opened at a later time. See, for example, U.S. Pat. No. 5,633,071, issued to Moore Business Forms, Inc. However, this patent describes a form having the disadvantage of not providing a return envelope, nor providing for Information Based Indicia (IBI) or showing of a Facing Identification mark (FIM) per the requirements of the United States Postal Service (U.S.PS). Various means are employed to make a portion of the form tear open in a preferred manner. For example, a perforated or die-cut sheet may be used in this way. Alternatively or additionally, a number of parallel glass fibers (fiberglass) may be provided to give a particular strip of material the strength needed for easy removal without breaking apart. A problem with this approach is that the glass fibers lie only in a straight line, so that the material to be removed must be a straight strip. What is needed is a reinforcing coating which can be applied to material which is not straight, allowing its removal without breaking up.

A mailing form providing these advantages absent from the currently available forms, including the provision of a return envelope, and areas for IBI and FIM indicia are needed in the art.

SUMMARY OF THE INVENTION

In accordance with one aspect of the invention, there is provided a mailing form including a lower sheet of material having first and second ends, with a first transverse folding line between the first and second ends, and an upper sheet of material overlying and aligned with the lower sheet of material. The upper sheet of material includes a first upper sheet portion, an outer flap, and an inner flap, the outer flap and the inner flap being separated by a first cut line, and the outer flap extending to the second end of the lower sheet. A first adhesive system forms a bond between the first end and an adjacent surface of the first upper sheet portion and a second adhesive system forming a temporary bond between the second end and the outer flap. The second adhesive system includes an adhesive permanently bonded to the lower sheet, the second adhesive system being of a type which forms a permanent bond with another sheet of material after separation from the outer flap.

In another aspect of the invention, the inner flap comprises a postal indicia portion which can be folded to meet the top edge of the outgoing envelope in order to automatically position an Indicia Based Identification (IBI) code in proper position as required by the U.S. Postal Service (U.S.PS). In addition, a Face Identification Mark (FIM) is properly positioned, without skewing, no more than one-eighth inch from that top edge, and preferably flush with that edge. This FIM positioning is also required by the U.S.PS.

BRIEF DESCRIPTION OF THE DRAWINGS

One preferred embodiment of the subject invention is hereafter described with specific reference being made to the following figures.

DETAILED DESCRIPTION

Figure 1:
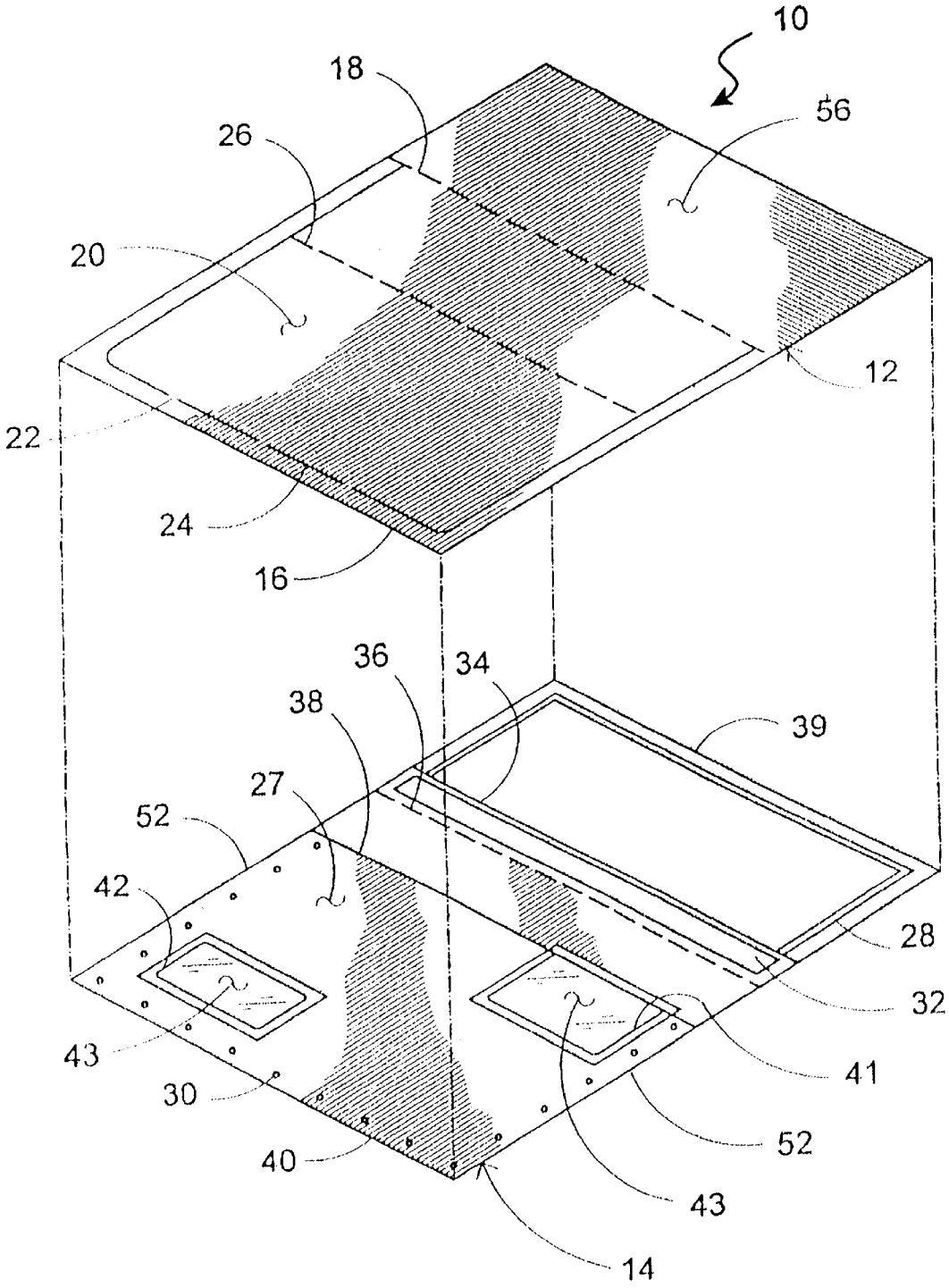
FIG. 1 is an exploded isometric view of a mailing form made in accordance with the present invention, showing the two paper sheets joined to make the form in an exploded relationship.

FIG. 1 is an exploded isometric view of a mailing form 10, which includes an upper sheet 12 and a lower sheet 14. It is to be understood herein that the words "upper" and "lower" imply directions which are arbitrarily chosen merely to establish a consistent way of describing the components and features of this form. Sheets 12 and 14 may be composed of any of a number of tic materials and composites which are used as paper substitutes.

Mailing form 10 is particularly configured to facilitate subsequent processing through a typical non-impact printer, such as a laser printer or an ink jet printer commonly found in both small and large offices and computer rooms. Form 10 is designed so that all necessary information is to be printed on a single side of form 10; more specifically, all printing occurs on the upper side 56 of upper sheet 12. Where form 10 is to be used with a laser printer, the choice of materials and configurations is made to facilitate the movement of the form 10 through the hot pressure rolls of a non-impact printer fuser without damage to either the form or the fuser. While mailing form 10 is provided for printing in the shape of a single sheet of paper, which is preferably a standard size, such as 8½ inches wide by 11 inches long, after printing it can be folded into an initial envelope containing a statement to be sent to a customer. After this initial envelope is received and opened, the customer can return a part of the form, together with a check, if required, in a return envelope also formed from a portion of mailing form 10.

Upper sheet 12 includes a removable "U" shaped outer strip 16, extending around a periphery of sheet 12 from a first perforated line 18 extending entirely across the sheet 12. Outer strip 16 is preferably joined to the adjacent inner flap 20 of upper sheet 12 by a means of a number of ties 22 extending between slits 24 through the material of the sheet 12. A second perforated line 26 extends across inner flap 20.

Lower sheet 14 includes, on an upper (or inner) surface 27, adhesive features which are used in the process of jointing the two sheets 12 and 14. A "U" shaped, pressure sensitive adhesive strip 28 extends around the periphery of an end of lower sheet 14, which is fastened to an end of upper sheet 12 opposite the end at which "U" shaped strip 16 is formed. A number of pressure sensitive adhesive dots 30 are formed in a "U" shaped pattern beneath to strip 16. Both adhesive strip 28 and adhesive dots 30 are preferably moved inward, away from the edges of the sheet 14, so that subsequent passage of the mailing form 10 through the fuser of a non-impact printer cannot squeeze adhesive material outward to or past the edges of form 10. The reason, of course, is that adhesive squeezed out from form 10 could otherwise become a damaging contaminant on the surface of the fuser rollers.

Lower sheet 14 also includes a number of features which are subsequently used to form envelopes. A remoistenable adhesive layer 32 extends between a first scored line 34 and a perforated line 36. It should be understood that a scored line is weakened to facilitate folding at a preferred location and a perforated line includes voids to facilitate either folding or separation by tearing. Various well-known form manufacturing processes can be used to form score lines and perforated lines as shown. For example, a perforated line formed by die cutting can be used to locate a fold as well as to locate a line of separation. Lower sheet 14 also includes a second scored line 38 extending transversely across the sheet 14 midway between a first end 39 and a second end 40 of lower sheet 14. Lower sheet 14 also includes at least a first aperture 41 and a second aperture 42, each of which is covered by a transparent sheet 43, fastened in place using a permanent adhesive. Each transparent sheet 43 is preferably composed of a heat resistant material, such as cellulose, which will not suffer excessive dimensional changes and wrinkling as mailing form 10 is subsequently passed through the hot fuser rolls of a typical non-impact printer.

Figure 2:
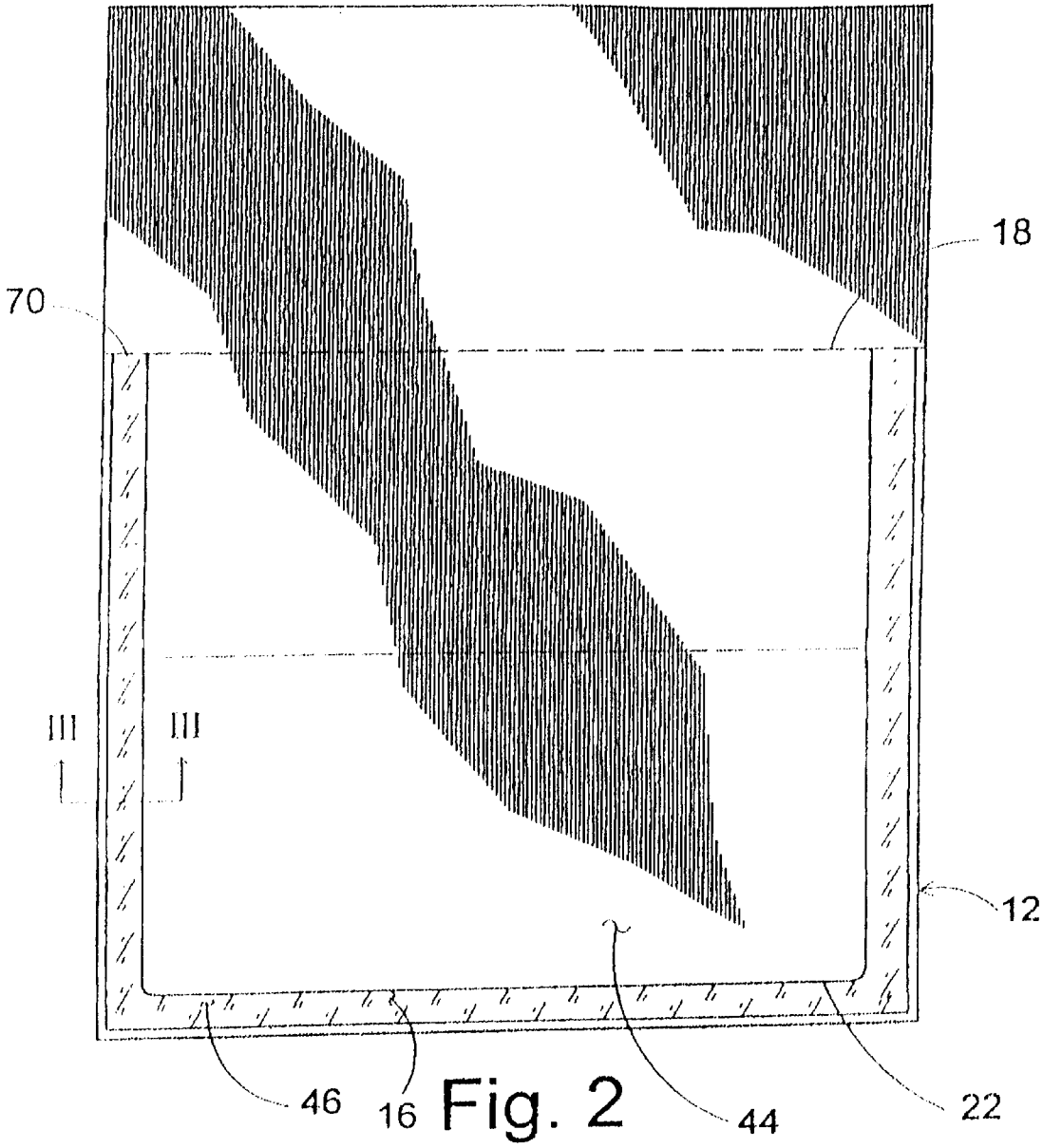
FIG. 2 is an underneath plan view of the upper paper sheet of the mailing form of FIG. 1.

FIG. 2 is an underneath plan view of upper sheet 12, showing the under (inner) surface 44 thereof. A reinforcing coating 46 is applied to the inner surface of "U" shaped outer strip 16 to facilitate the removal of strip 16, as a single piece, as described hereafter.

Figure 3:
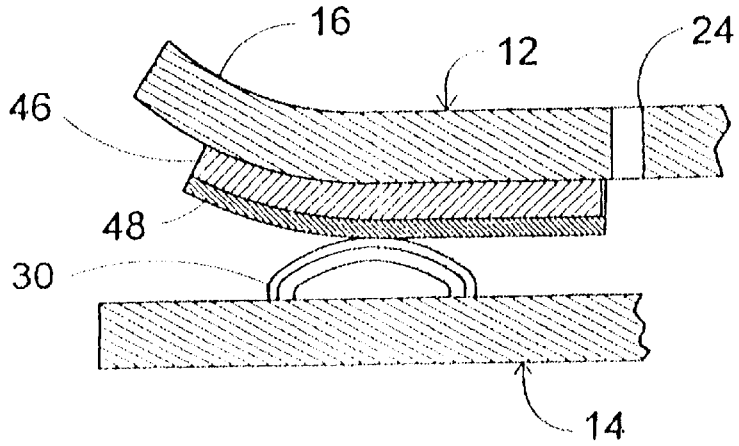
FIG. 3 is a cross-sectional elevational view of an outer flap portion of the upper paper sheet of FIG. 2, taken across lines III—III in FIG. 2, and being pulled away from an underlying lower paper sheet.

FIG. 3 is a cross-sectional elevation of outer strip 16, taken as indicated by section lines III—III in FIG. 2, as strip 16 is pulled away from underlying lower sheet 14. Reinforcing coating 46 is preferably composed of a coatable substance, such as varnish, having chopped fibers suspended therein. The chopped fibers may individually be 1/16 to 3/16 of an inch long and may be, for example, made from either fiberglass or from a natural material, such as cotton. An advantage of using a natural material, such as cotton, is that the biodegradability of the product after its disposal is enhanced. In general, various types of material and synthetic fibers typically used in the production of textiles may be chopped to length for use as the filler. To speed the production of mailing form 10, the varnish used in reinforcing coating 46 is preferably of a type which is cured or "set" by means of the application of ultraviolet light. Further, by suspending the chopped fibers in the varnish, the additional steps of applying the fibers to the coated varnish after it is spread on the sheet is eliminated. The reinforcing coating 46 may be used to reinforce any portion of a sheet of paper, such as binder holes, as well as used to reinforce a removable portion, such as strip 16.

In the assembly of upper sheet 12 and lower sheet 14 to form mailing form 10, strip 16 is brought together with adhesive dots 30. After the subsequent printing process, strip 16 is removed and discarded. To facilitate separation of strip 16 from adhesive dots 30 at this point, a silicon release coating 48 is preferably coated on the exposed surface of reinforcing coating 46 during the production of upper sheet 12.

Referring again to FIG. 1, mailing form 10 is formed by aligning upper sheet 12 with lower sheet 14 and by pressing these sheets together. Pressure sensitive adhesive strip 28 holds sheets 12 and 14 together along first end 39 and partly along both longitudinal sides 52, while adhesive dots 30 hold sheets 12 and 14 together along second end 40 and partly along both sides 52. In this way, the sheets 12 and 14 are held together for processing through a non-impact printer. After this assembly process, the form 10 is ready for the printing of information on upper surface 56.

Figure 4:
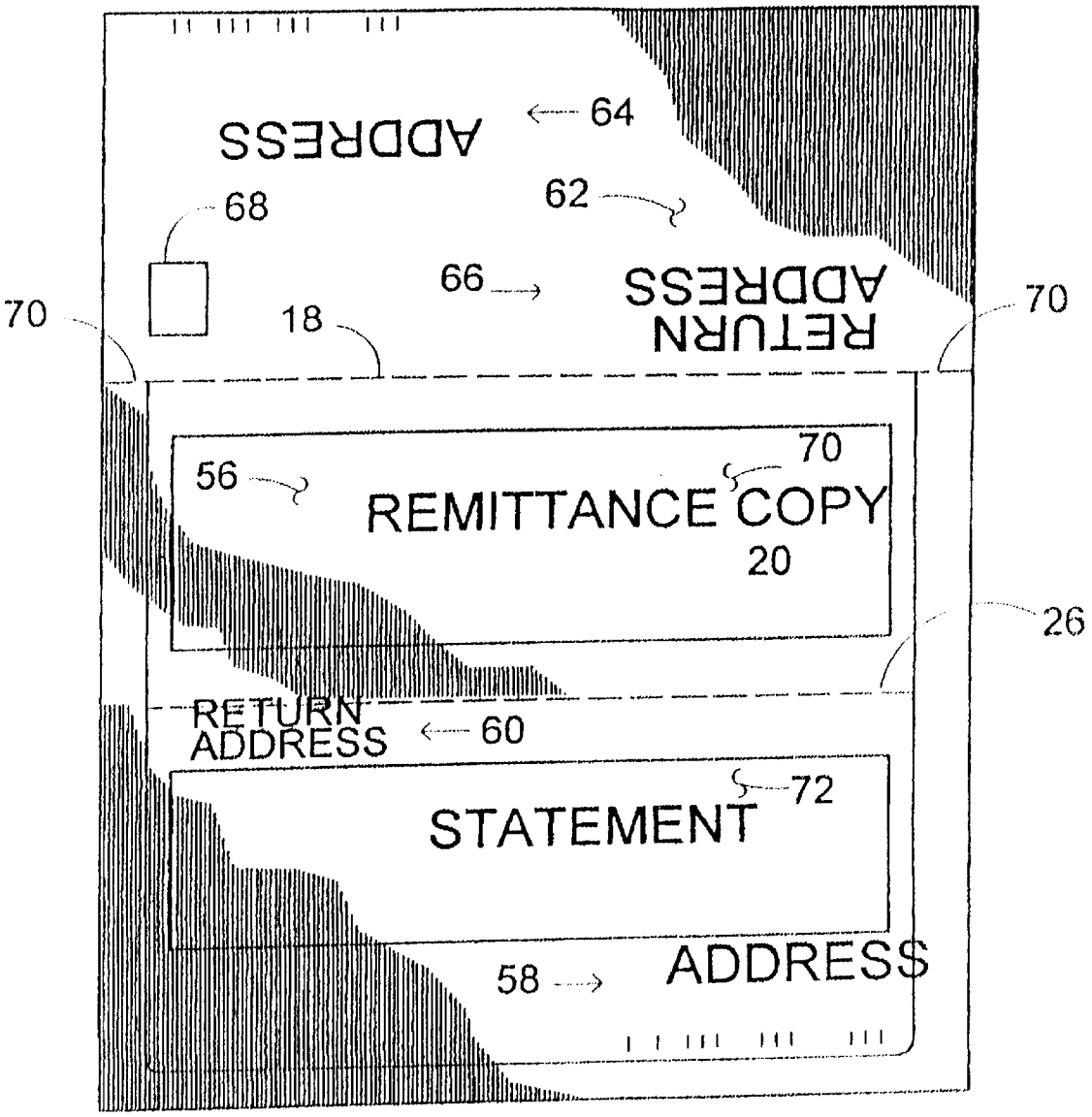
FIG. 4 is a plan view of the mailing form of FIG. 1 after a printing step.

FIG. 4 is a plan view of mailing form 10 after exemplary information is printed on upper surface 56. This information includes address and return address information for both an initial envelope configuration, in which form 10 is mailed to the customer, and for a return envelope configuration, in which the customer is expected to return a remittance portion of the form 10, together with additional material, if necessary, such as a check. Specifically, the address of the customer (or other individual or organization to which form 10 is initially sent) is printed in a first address field 58, and the return address of the organization initially sending the form is printed in a first return address field 60.

An end portion 62 of mailing form 10 is eventually used as a return envelope. Thus, the address of the organization expecting to receive the return envelope is printed in the second address field 64, and the address of the customer is printed in second return address field 66. Other envelope information, such as a stamp locating graphic 68, may also be printed. The envelope information on portion 62 is preferably printed in an inverted orientation relative to the other information printed on mailing form 10. In order to expedite the handling of materials through the postal system, a POSTNET bar code may be printed within each address field 58 and 64.

The information to be sent to the customer by means of mailing form 10 is printed on inner flap 20, which is divided into a first flap portion 70 and a second flap portion 72 by perforated line 26. All of first flap portion 70 can be used for such information. The envelope addressing information contained in fields 58 and 60 are arranged to align with apertures 41 and 42 following the folding steps described hereafter with respect to FIGS. 5 and 6. Therefore, the remaining area of second flap portion 72 can be used for informational content, which will be exposed only after the first envelope to be made using form 10 is opened. For example, the informational content of a statement may be printed on second flap portion 72, while a remittance copy to be returned by the customer may be printed on first flap portion 70.

Figure 5:
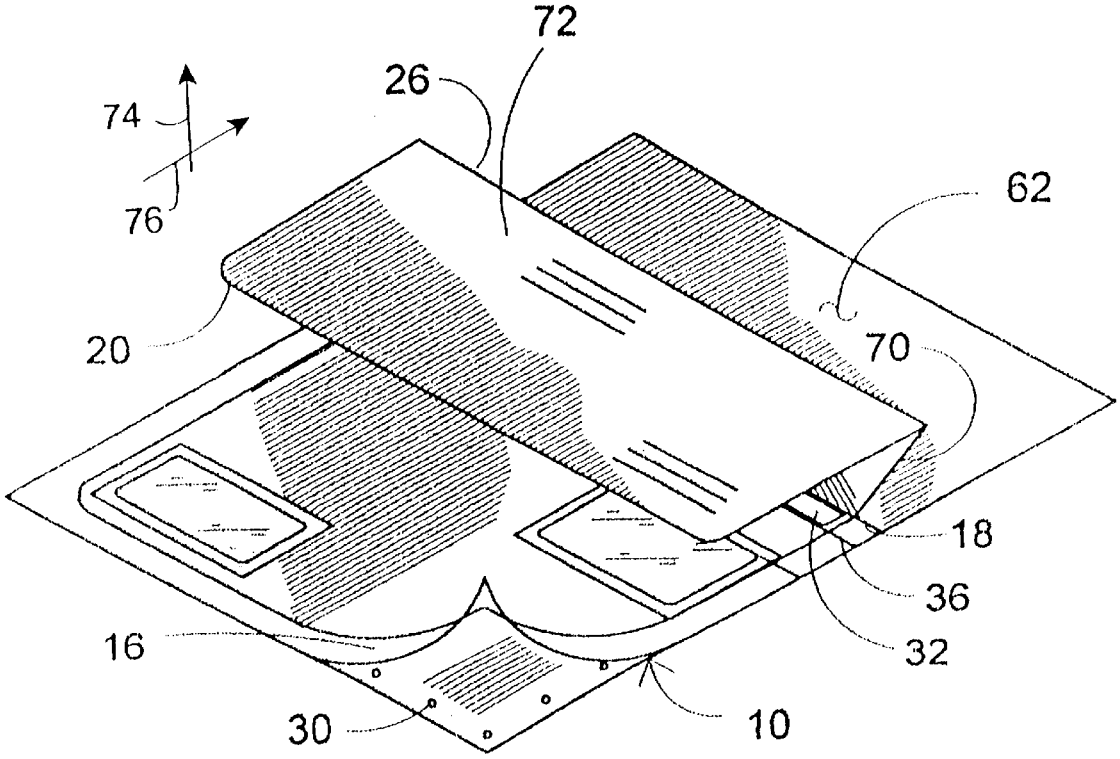
FIG. 5 is an isometric view of the mailing form of FIG. 1 during a first folding step, which occurs after the printing step.
Figure 6:
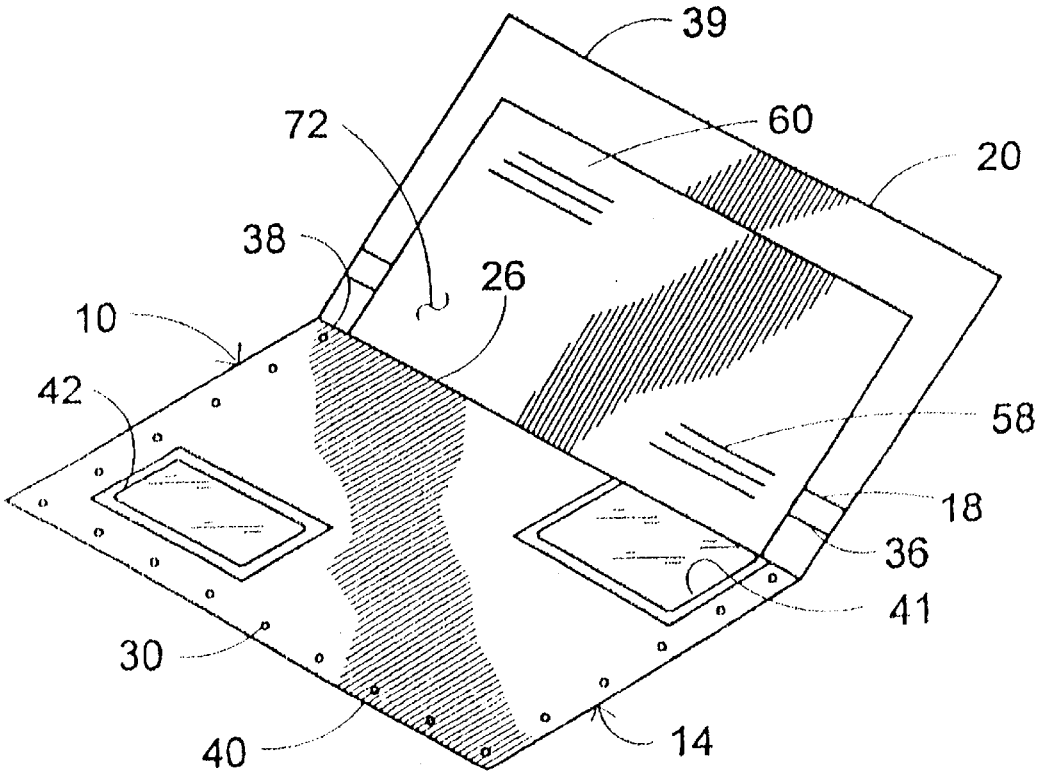
FIG. 6 is an isometric view of the mailing form of FIG. 1 during a second folding step, which occurs after the first folding step of FIG. 5.

Referring to FIGS. 5 and 6, outer strip 16 holds inner flap 20 in place and maintains a cover over adhesive dots 30 as mailing form 10 is fed through the printer during the printing process. After the printing process, inner flap 20 is pulled away from lower sheet 14, as ties 22 are torn apart, and outer strip 16 is separated and removed from the remainder of form 10. Reinforcing coating 46 facilitates the removal of outer strip 16 as a single piece, and the silicone release agent applied to the exposed surface of coating 46 allows strip 16 to be easily pulled away from adhesive dots 30, which are left in a condition ready for reuse. After outer strip 16 is removed, it is discarded.

More specifically, FIG. 5 shows an isometric view of mailing form 10 during the performance of a first folding step after the printing operation. First, inner flap 20 is released and folded along lines 18 and 26. Specifically, inner flap 20 is folded upward, in the direction of arrow 74, and longitudinally, in the direction of arrow 76, with bending occurring along perforated lines 18 and 26. After this folding step is completed, second flap portion 72 is upwardly exposed, while first flap portion 70 (shown in FIG. 4) is folded downward against end portion 62. Thereafter, outer strip 16 is removed, and adhesive dots 30 are upwardly exposed.

FIG. 6 shows an isometric view of mailing form 10 during the performance of a second folding step, which occurs after the first folding step of FIG. 5 and removal of outer strip 16. The combination of portion 62 and folded portions 70 and 72 and that portion of lower sheet 14 against which portions 70 and 72 are folded along scored line 38 to enclose inner flap 20 as the ends 39 and 40 of lower sheet 14 are brought together. When this folding step is completed, form 10 is closed, and sealing occurs as pressure sensitive adhesive dots 30 are compressed against end portion 62. As noted above, address field 58 is exposed through aperture 41 and return address field 60 is exposed through aperture 42. At this point, mailing form 10 is converted into an envelope, which after the application of postage, is ready for mailing to the customer.

Figure 7:
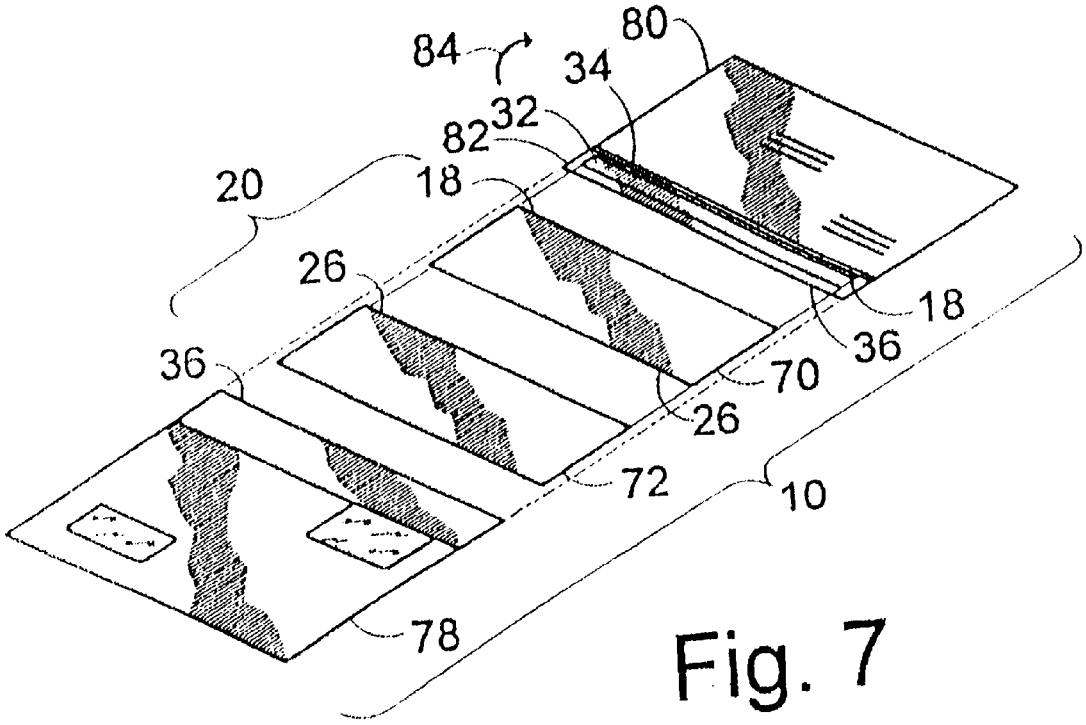
FIG. 7 is an isometric view of the mailing form of FIG. 1 after receipt, opening, and separation.

Referring now to FIG. 7, after the customer receives form 10 as folded for mailing, the customer first opens the envelope by peeling upper sheet 12 down, thereby breaking the seal formed by adhesive dots 30. With the seal broken, form 10 is snapped or pulled apart, thereby causing perforations 36 to separate and free scrap portion 78, and inner flap 20 is exposed. Next, inner flap 20 is pulled back into an essentially flat, unfolded condition, fully exposing the information printed on both second flap portion 72 and first flap portion 70 (shown in FIG. 4). Next, inner flap 20 is detached from the remainder of form 10 along perforated line 18, and first flap portion 70 and second flap portion 72 are separated from one another along perforated line 26. Inner flap 20 thus forms two separated documents, one of which may be statement 70 and the other of which may be remittance portion 72 to be returned by the customer within a return envelope 80, along with other materials as required, such as a remittance check.

FIG. 7 thus shows an isometric view of the materials of mailing form 10 after they have been separated into component parts by the customer. For convenience in FIG. 7, the edges formed by tearing a sheet apart along a perforated line are given the same reference number as the perforated line. The width of the pocket formed in return envelope 80, as determined by the distance between the portions of adhesive coating 28 extending along longitudinal sides 52 (as shown in FIG. 1) is preferably greater than six inches, thereby permitting the insertion of an ordinary consumer check without folding. As shown in the preferred embodiment where the two sheets 12 and 14 are standard sizes, such as 8½×11 inches or A4 size, the internal width of envelope 80 approximates 7½ inches, and in fact is made wider than remittance portion 72 so that it may also be inserted in envelope 80 without folding. The necessary materials are placed in return envelope 80, adhesive layer 32 is moistened, and flap portion 82 is folded in the direction of arrow 84 about scored line 34 to seal the return envelope.

A number of variations can be applied within the scope of the present invention. For example, as shown in FIG. 4, the information in second address field 64 and second return address field 68 is printed in an inverted relationship with respect to other information printed on the mailing form 10. This is done to allow both the initial envelope and the return envelope to open from the top, as most people are familiar with opening envelopes in this way. Alternatively, the printed information may be oriented in a common direction if either the initial envelope or the return envelope is allowed to open from the bottom.

As shown in FIG. 7, sealing flap 82 of the return envelope 80 extends from the rear of this envelope, having been formed as a part of lower sheet 14 (shown in FIG. 1). Alternately, a sealing flap can be provided, extending from the front of the envelope, being formed as a part of upper sheet 12 (also shown in FIG. 1), at the expense of shortening first flap portion 70, reducing the space available for printed information.

These features described herein can also be incorporated into a second embodiment which includes additional modifications which can provide further advantages. For example, the second embodiment provides an addressee window which can accommodate printing of a delivery point POSTNET bar code, including the 11-digit bar code preferred by the U.S.PS. In addition, this second embodiment can include a third window for showing a postage indicia area in compliance with U.S.PS requirements, e.g., two-dimensional bar code (IBI) and a FIM mark correctly positioned ⅛ of an inch or less from a top edge of the envelope. In accordance with this postage indicia window, the postage indicia, e.g., IBI bar code and FIM mark, can be printed on a modified second flap portion which can comprise a remittance portion and a postage indicia flap portion. The postage indicia portion of the second flap is preferably divided from the remittance copy by a die-cut along a longitudinal axis of the form. The longitudinal die-cut preferably provides a remittance copy of greater width than the postage indicia flap.

Advantageously, the postage indicia flap separates from the remittance copy along the longitudinal die-cut such that the postage indicia flap is not folded under the first flap with the remittance copy, but rather is positioned so that its top edge, opposite the edge connecting to the first flap, is flush with and contacts the top edge of the sheet forming the inner face of the outgoing envelope.

To provide for proper size and positioning of the postage indicia flap, a portion of the second flap is cut out between the top edge of the postage indicia flap and the intersecting tear line forming the upper edge of the envelope flap. The cut-out area is contiguous with the U-shaped strip bordering the first and second flaps so that the cut-out area is removed with the U-shaped strip.

In addition, the postage indicia flap is configured in a notched fashion at its top edge to provide for exposure of adhesive on the inner face of the outgoing envelope so that a bond can form and hold the inner faces of the outgoing envelope together when folded and formed.

Figure 8:
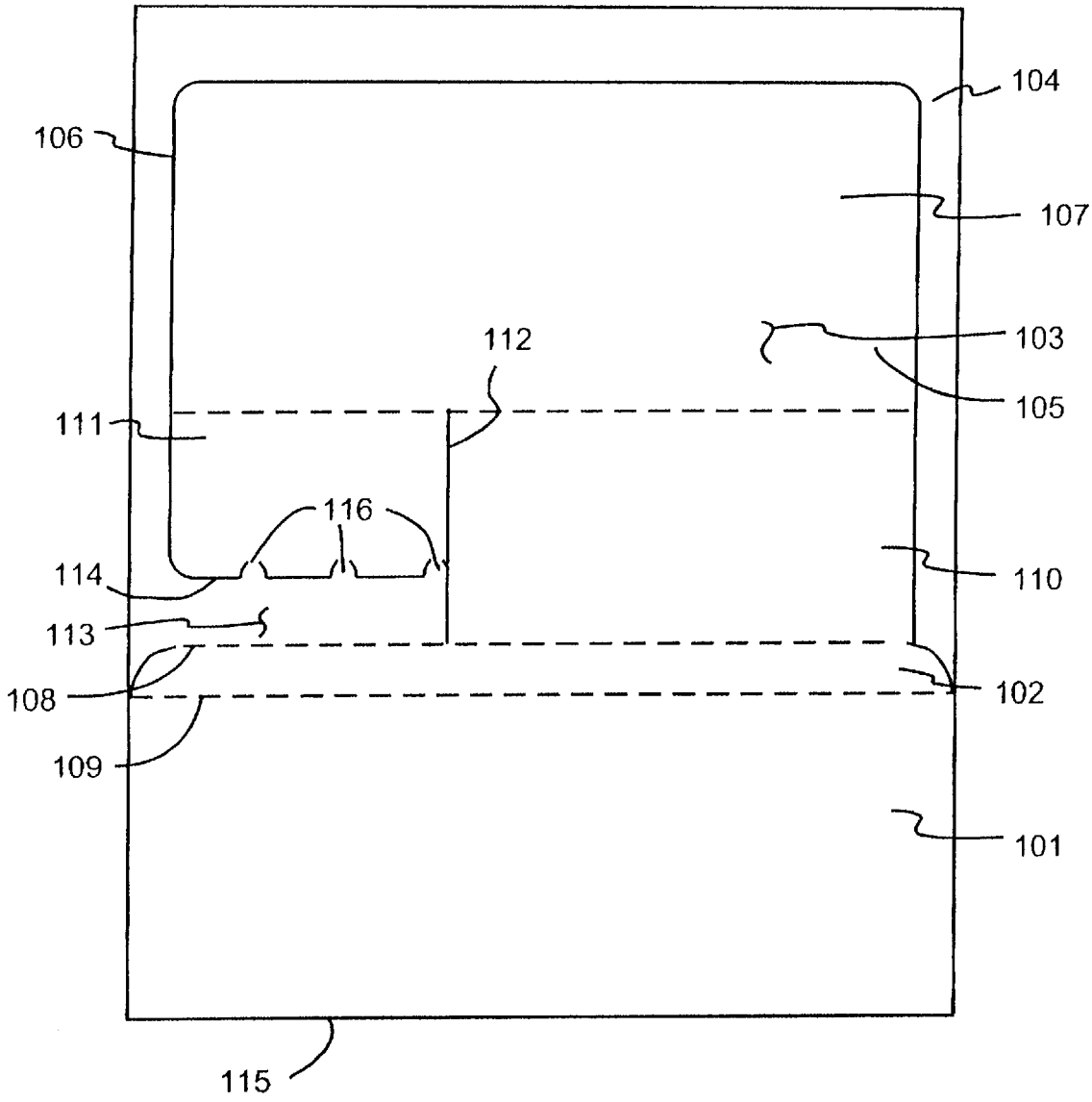
FIG. 8 is a plan view of a front (outer) face of the upper sheet of a second embodiment of the subject mailing form providing for a flush FIM mark on the outgoing envelope.

The features of this second embodiment of the subject invention are further illustrated in the accompanying drawings, FIGS. 8–12. FIG. 8 shows an outer face of an upper sheet of the second embodiment of the mailing form 100 showing return envelope portion 101, with closure flap 102, and inner flap 103 which is bordered by a removable substantially U-shaped strip 104. Each of these features is analogous to those described for the first embodiment of the subject invention. In addition, this second embodiment includes perforations or die-cuts for separating the different portions of the form or for providing weakened fold lines for facilitating folding of the various sections in predetermined positions. For example, perforation 105 and die-cut 106 are provided to form a first flap portion 107. First flap portion 107 is thereby separable from the remainder of the form along perforation 105. Perforation 108 provides a separation line to separate return envelope portion 101 from the remainder of the form, and score line 109 forms a fold line to facilitate folding of closure flap 102 over for sealing the return envelope portion 101.

However, this second embodiment is varied from the first embodiment, having inner flap 103 which comprises first flap portion 107, second flap portion 110 useful as a remittance portion, and a postage indicia portion 111. Remittance portion 110 is divided from postage indicia portion 111 by die-cut line 112. In addition, a removable area 113, which is contiguous with strip 104, formed by die-cut 106, is provided at an outer edge 114 of postage indicia portion 111 so that the removable area 113 can be removed with strip 104 and leaving postage indicia portion 111 of an appropriate size (height) to contact and align with edge 115 of the form when remittance portion 110 is z-folded along fold line perforations 105 and 108 over envelope portion 101 and first flap portion 107. Postage indicia portion 111 is not folded at perforation fold line 105.

Further, removable area 113 is configured to form notches 116 in the top edge of postage indicia portion 111 so that adhesive disposed on the inner faces of the form are exposed and can bond the form into a folded outgoing envelope configuration. Die-cut 106 is provided with ties (small, uncut sections) in various positions to retain the integrity of the form when being processed.

Figure 9:
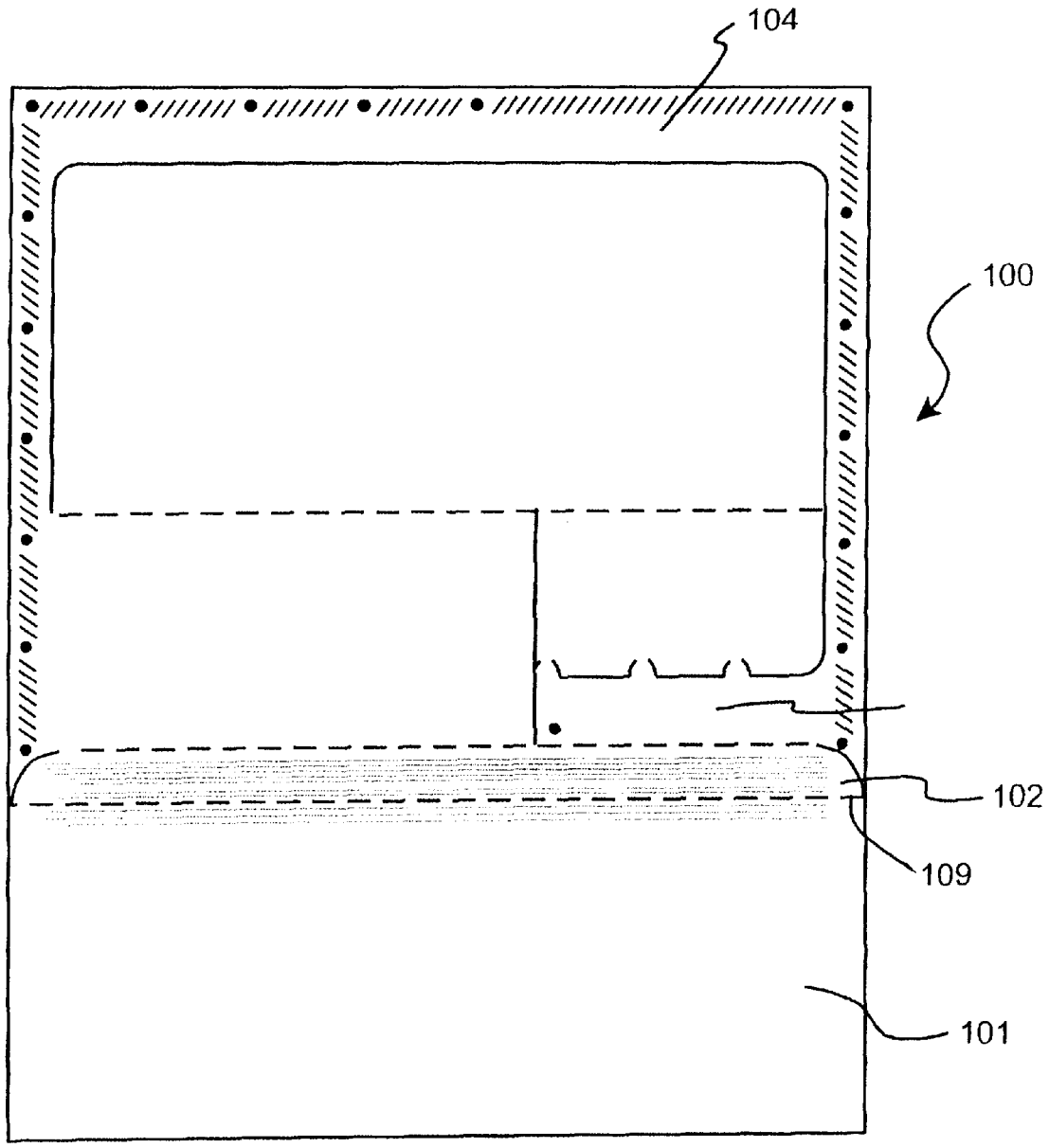
FIG. 9 is a plan view of a back (inner) face of the upper sheet of the second embodiment, illustrating placement of adhesive and adhesive-release materials.

FIG. 9 shows an inner face of the upper sheet (in mirror image) of form 100, illustrating the alternating adhesive (solid dots) and adhesive release (diagonal lines) disposed on strip 104. The adhesive spot shown on removable area 113 can provide improved integrity of the form when processed. In addition, pressure sensitive adhesive (horizontal lines) is shown disposed on the contact areas of the return envelope portion 101 and closure flap 102. The pressure-sensitive adhesive disposed on return envelope closure flap 102 can serve a dual purpose. First, the adhesive can provide a seal for closing the return envelope. Second, this adhesive can provide a bond for holding a transparent sheet disposed between the upper and lower sheets. The transparent sheet, described in more detail in reference to FIG. 12, forms the see-through window portions of the form and can add support or reinforcement to the form, providing a strengthened connection between the die-cut or perforations separating the separable sheets or sections of the sheets, and covers adhesive for flap closure to form a temporary protective strip.

Figure 10A:
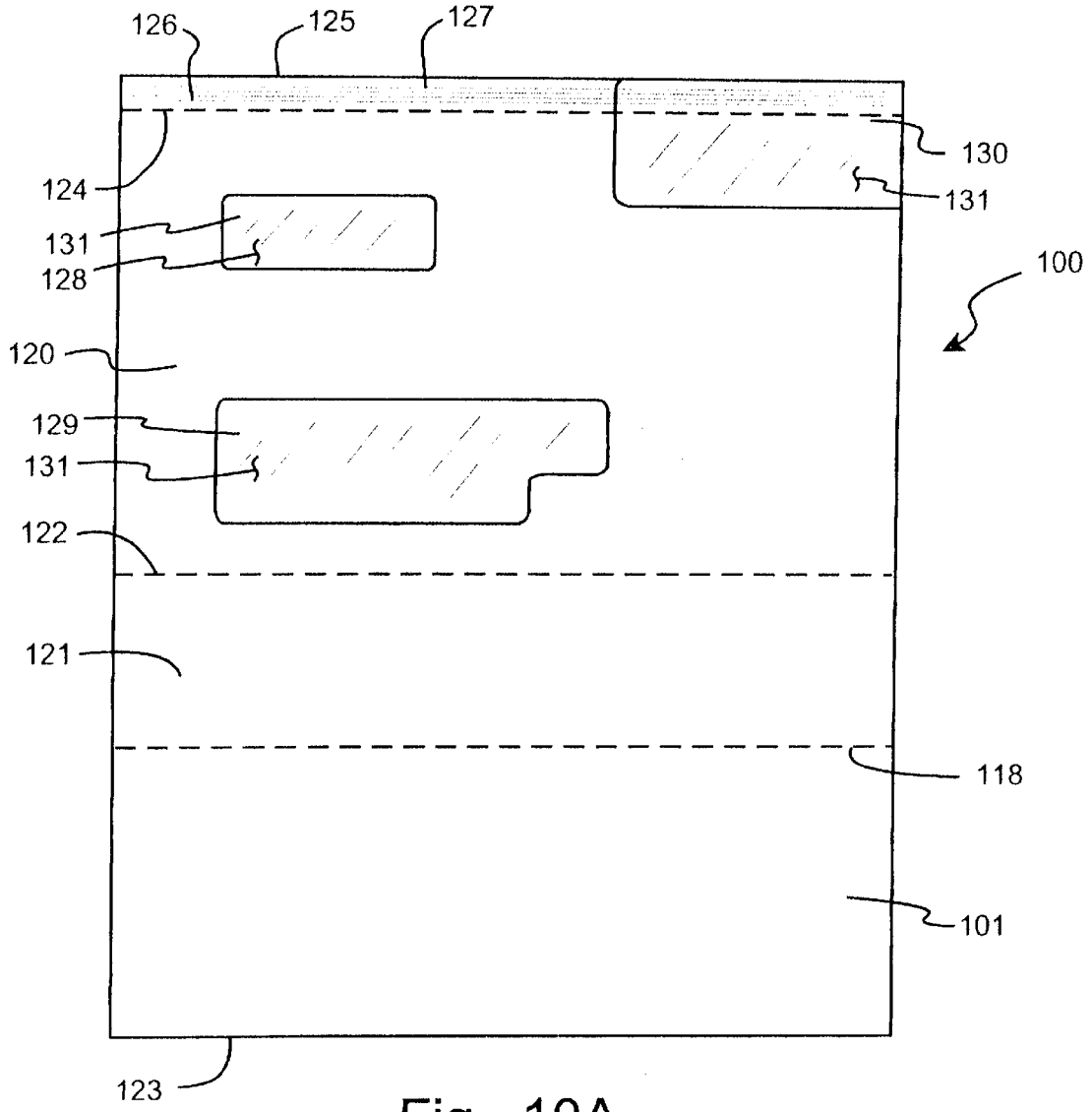
FIG. 10A shows a plan view of an outer face of the lower sheet of a second embodiment of the subject invention, illustrating transparent windows for addressee information, return address, and postage indicia.

FIG. 10A shows an outer face of a lower sheet of the second embodiment of mailing form 100. The lower sheet comprises return envelope portion 101, being separable from the remainder of the form along perforation 118. Perforation line 118 is aligned with the perforation 109 on the upper sheet. The lower sheet further comprises a top end portion 119 comprising a front face 120 of the outgoing envelope and a part of a back face portion 121 and return envelope portion 101. The envelope is formed by adhering inner face of the lower sheet (which is exposed after strip 104 is removed) to the outer face of the upper sheet when the form is folded substantially midway along perforation fold line 122, in a direction into the page as shown. Adhesive material 123, preferably a commercially available pressure-sensitive adhesive, can be disposed between transverse perforation 124 and top edge 125 to contact and adhere a leading edge of the transparent sheet (disposed on the opposing face as shown), which is folded over edge 125 to contact the outer face of the upper sheet, integral with strip 127. Perforation 124 can be made through the outer transparent layer and the upper sheet so that strip 127 is removable from the remaining layers and providing a means for opening the outgoing envelope. In this case, a strip of adhesive release material can be applied to the outer face of the return envelope, parallel to edge 115 shown in FIG. 8 such that it corresponds to adhesive strip 126 in FIG. 10A.

Figure 10B:
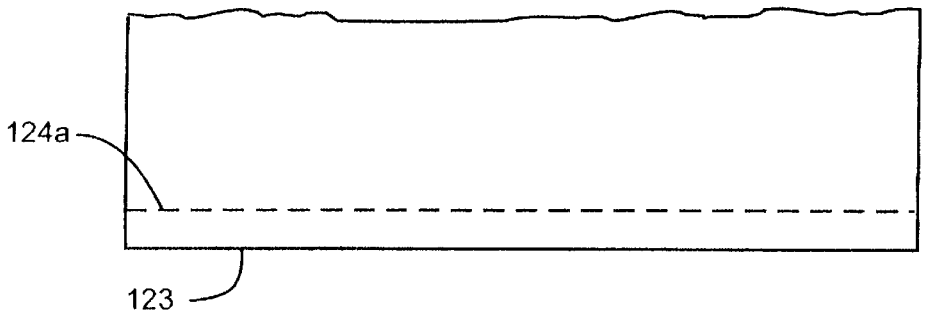
FIG. 10B shows a section of one end of the lower sheet of FIG. 10A, illustrating a variation thereof having a perforation across the bottom edge.

Alternatively, perforation 124 can be made through all the layers of the form, including a corresponding perforation 124*a* through all layers at the bottom edge 123 of the form (see FIG. 10B). Thus, in the folded configuration of the outgoing envelope, perforations 124 and 124*a* align to provide a tear-away strip through all layers of the form. Removal of the tear away strip comprised of all layers of the form also provides a means for opening the outgoing envelope. It would be understood that the variation comprising a perforation 124*a* will require a slightly different placement of the adhesive at that end of the form. Specifically, the adhesive would correspond to a position inside the perforation 124*a* in order to maintain the integrity of the laminated form.

The front face 120 of the outgoing envelope further comprises cut-out areas 128, 129, and 130 which are backed by a transparent sheet 131 to serve as windows for viewing information printed on the outer face of the upper sheet, which is folded to position the printed information for such viewing. Preferably, the transparent backing sheet is a single sheet wherein portions thereof are exposed through the cut-out window areas. Window area 128 provides for viewing of a return address; window area 129 provides for viewing of the addressee address; and window area 130 provides for viewing postage indicia. Each of these windows is formed and positioned to meet U.S.PS requirements. For example, return address window 128 is preferably substantially rectangular and positioned toward the upper left-hand corner of the front face of the outgoing envelope. Addressee window 129 is preferably left of center on the envelope face and "stepped," having one portion wider than another. The narrower portion of the window is recessed so that U.S.PS-printed information, e.g., an 11-digit delivery point POSTNET bar code, can be printed in its entirety on the envelope rather than the transparent window material, thereby preventing smearing of the printed information. Postage indicia window 130 is positioned such that it forms the top right-hand corner of the outgoing envelope. This allows positioning of a FIM mark, as required by the U.S.PS, flush with, or at least within ⅛ inch of, the top edge 125 of the outgoing envelope.

Figure 11:
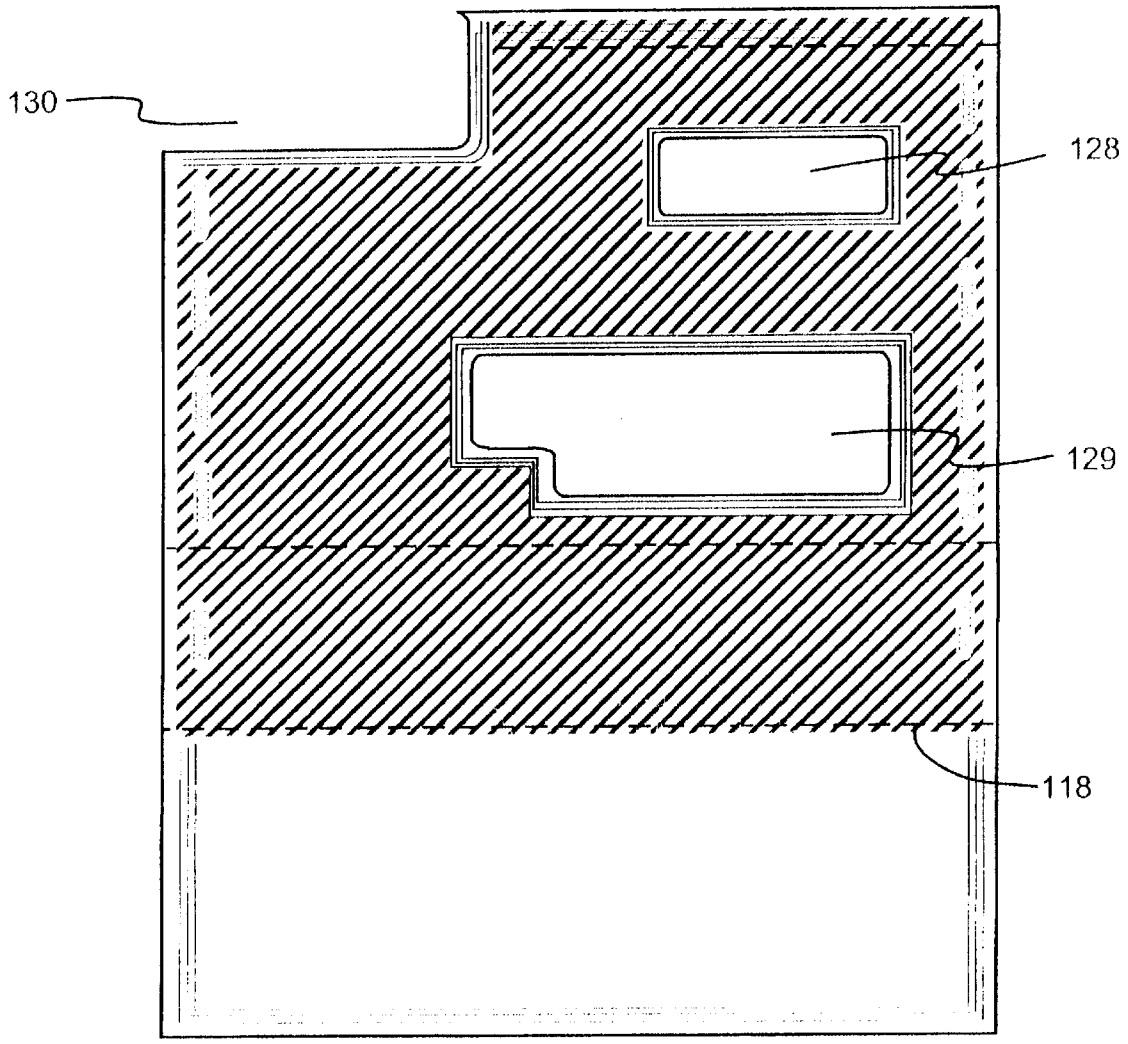
FIG. 11 shows a plan view of an inner face of the lower sheet of a second embodiment of the subject invention, illustrating adhesive and adhesive-release materials disposed thereon.

FIG. 11 shows an inner face of the lower sheet of the second embodiment of mailing form 100 to adhere a single transparent sheet (not shown) forming windows in cut-out areas 128, 129, and 130 and to reinforce the top edge 125 and perforation 118. In particular, FIG. 11 illustrates the placement of adhesive (striations) in relation to the various portions of the form. The adhesive is shown as striated and is preferably so disposed to reduce the amount of material used and to allow air to escape during the laminating process. In addition, the adhesive is preferably disposed so that such that a gap, preferably approximately 1⁄16 inch, is left along any edge of the underlying sheet to prevent oozing of the adhesive when heated, e.g., during a laser printing process. It would be understood that solid strips of adhesive or full coating of adhesive can also be used. The adhesive covers substantially the entire surface of the lower sheet from the top edge 125 to just below the perforation 118. Extending the adhesive past the perforation 118 provides for bonding of the transparent sheet thereto and reinforcement of that perforation.

To adhere the upper and lower sheets together in certain desired areas, alternating adhesive/adhesive release material is typically applied to the overlying transparent sheet and to the opposing face of the upper sheet so that adhesive matches to adhesive release on opposing faces.

Figure 12A:
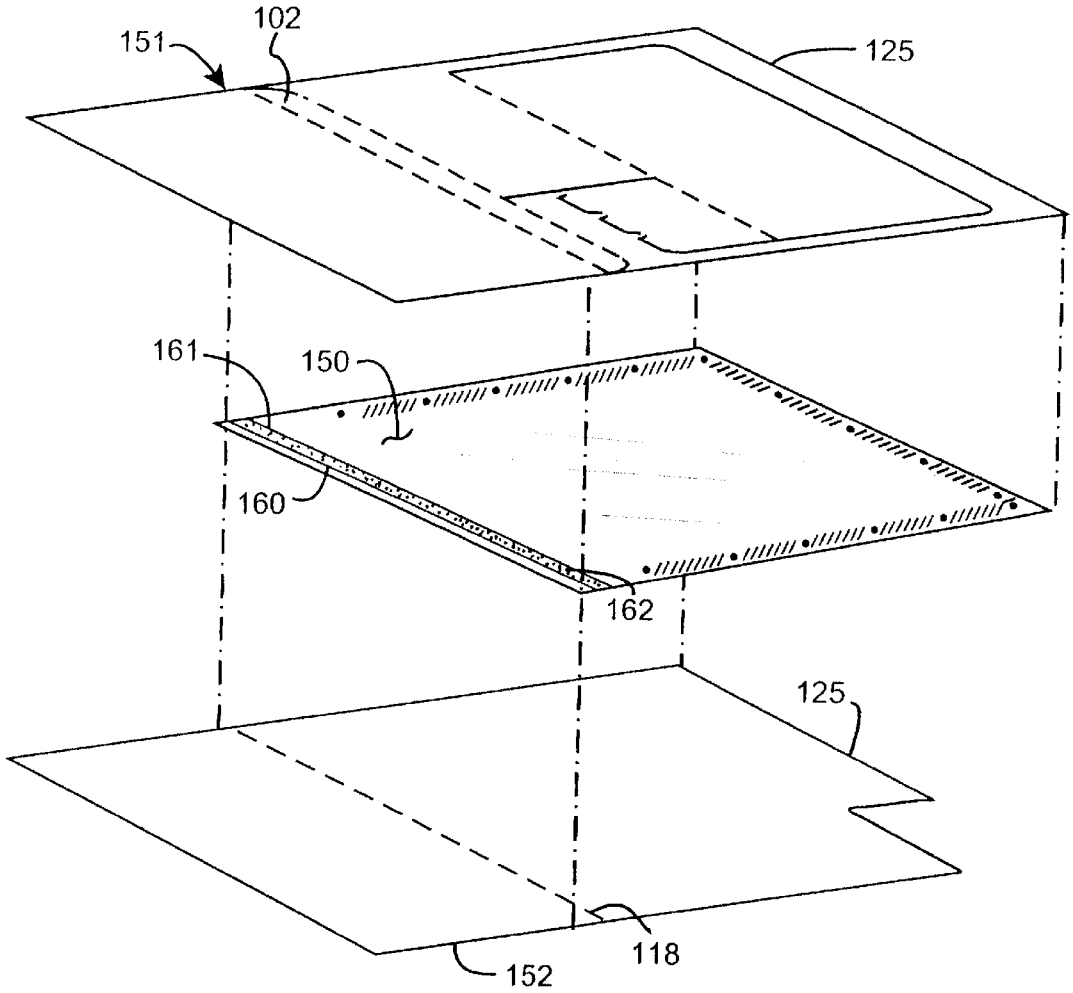
FIG. 12A shows a perspective view of a second embodiment of the subject mailer form, illustrating the transparent sheet disposed between the upper and lower sheets.

FIG. 12A shows the positioning of transparent layer 150 in relation to the upper and lower sheets 151 and 152, respectively. The transparent sheet is preferably rectangular, covering more than half to about two-thirds the surface area of the inner faces of the upper and lower sheets. As described above, the transparent sheet is preferably disposed such that it extends past perforation 118 of the lower sheet. Adhering the transparent sheet at this position on the lower sheet can advantageously provide reinforcement to perforation fold line 118. In addition, die-cuts 160 and 161 can be made through the transparent layer so that an adhesive protective strip 162 can be formed over the adhesive disposed on closure flap 102 and removed therefrom when sealing the return envelope. An adhesive release material (stippling) is correspondingly disposed on the face of the protective strip contacting the adhesive on closure flap 102 to facilitate the removal of the protective strip.

Figure 12B:
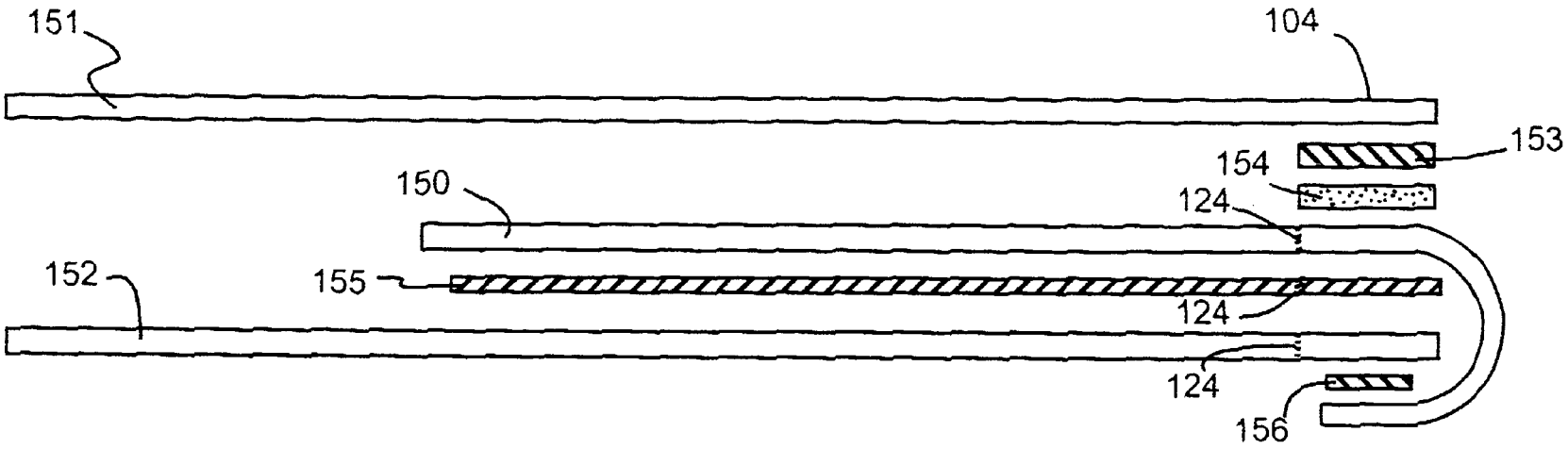
FIG. 12B shows a side view of the form of FIG. 12A illustrating the folded configuration of the transparent layer over the top edge of the lower sheet.

The transparent layer is shown to extend past the top edge 125 of the upper and lower sheets so that it can be folded over and made to contact the outer face of the lower sheet. The transparent layer preferably extends past the edge of the upper and lower sheets so that a strip approximately 3⁄16 inches overlaps onto the outer face of the lower sheet. This overlap of the transparent sheet is illustrated in FIG. 12B, which is a side view (not to scale) showing upper sheet 151, first adhesive layer 153 and adhesive release layer 154 for releasing strip 104, transparent sheet 150, second adhesive layer 155 for bonding the transparent sheet to the inner face of the lower sheet, lower sheet 152, and third adhesive layer 155 for bonding the overlapped portion of the transparent sheet to the outer face of the lower sheet.

Figure 13:
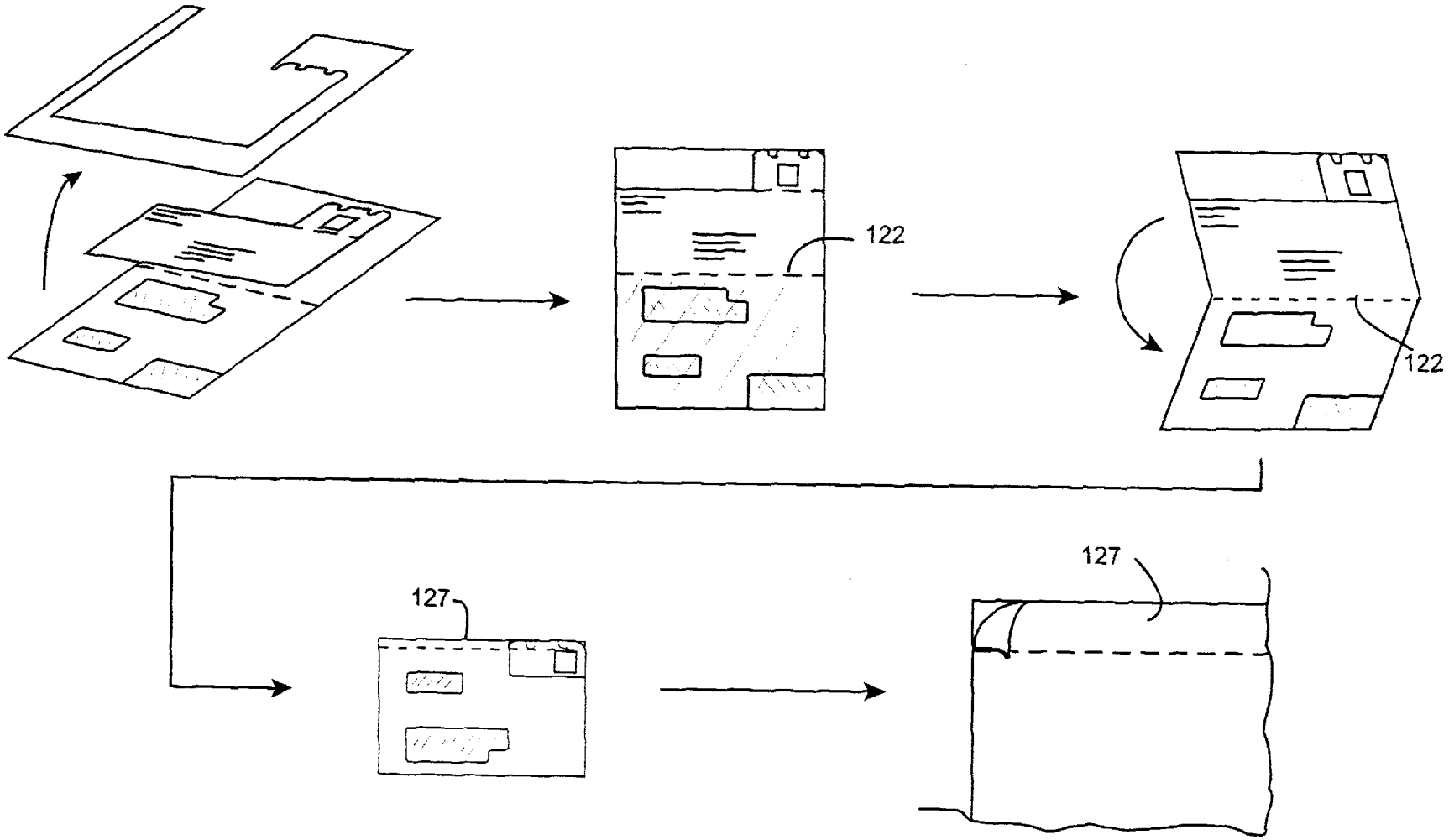
FIG. 13 shows a step-wise process illustrating the correct placement of IBI postage indicia in the upper right-hand corner of the outgoing envelope, including positioning of a FIM mark ⅛ of an inch or less from a top edge of the envelope.

FIG. 13 shows a step-wise process illustrating the correct placement of IBI postage indicia in the upper right-hand corner of the outgoing envelope, including positioning of a FIM mark ⅛ of an inch or less from (preferably flush with) a top edge 125 of the outgoing envelope. After strip 104 is removed, the inner flap is Z-folded into position to place the postal indicia portion 111 in accordance with the U.S.PS requirements. The form is folded along fold line 122 and sealed along the perimeter edges to form the outgoing envelope. A recipient of the envelope can be opened by removing strip 127 to permit access to the information contained within the outgoing envelope.

Figure 14:
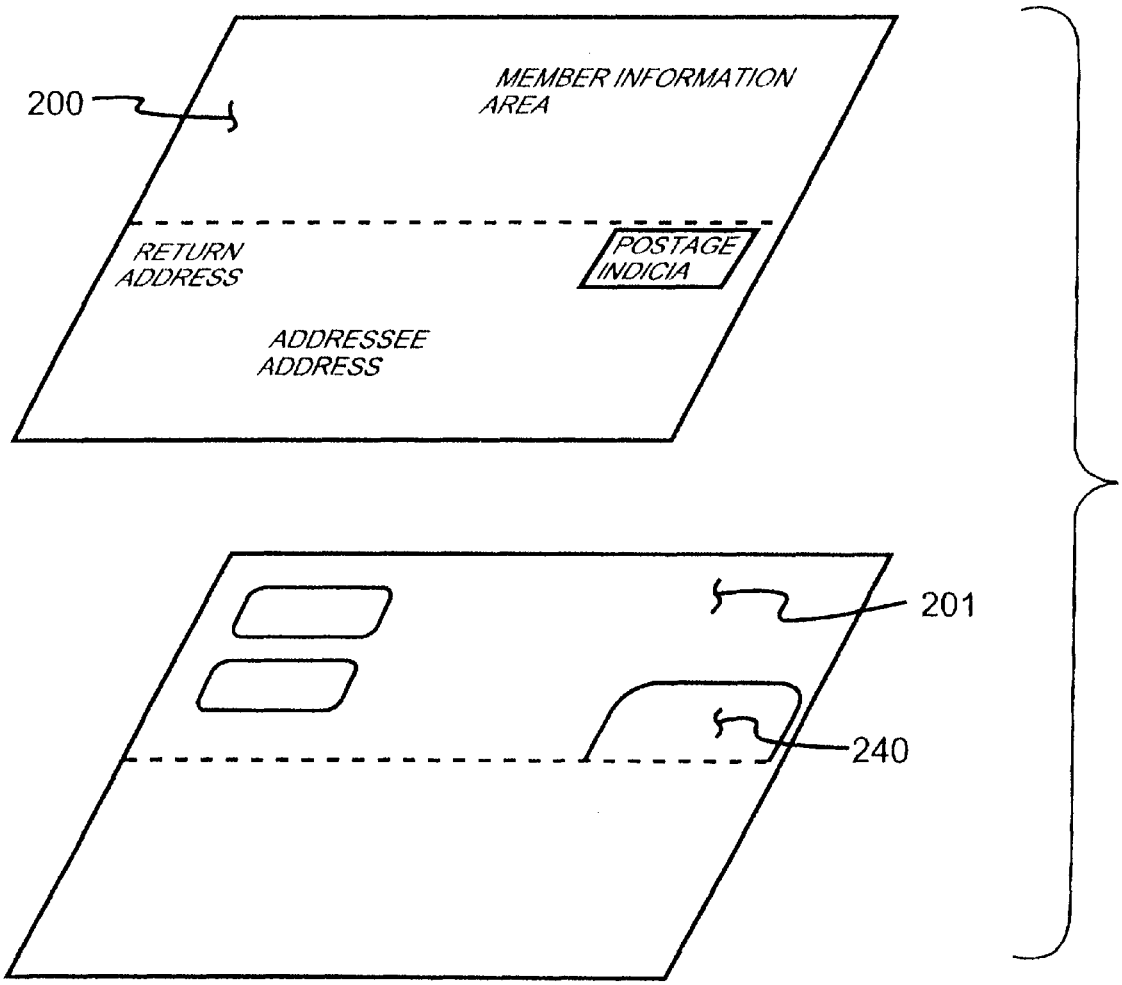
FIG. 14 shows in perspective, exploded view, a front face of a top substantially transparent layer and a front (inner) face of a bottom substantially opaque layer forming a separate embodiment of a mailer form. The positioning of a postage indicia window area on the opaque sheet is also illustrated.

A third embodiment of the subject invention concerns an IBI postage indicia window as applied to a two-ply mailer blank described in U.S. Pat. No. 5,791,553 and its progeny U.S. patent application Ser. No. 09/132,036, which are hereby incorporated by reference. Specifically, FIG. 14 shows in perspective, exploded view, a front face of a top substantially transparent layer 200 and a front (inner) face of a bottom substantially opaque layer 201 illustrating the positioning of a postage indicia window area 240 on the opaque sheet. The postage indicia are printed in area 241 such that it can be viewed when the mailer blank is in the folded configuration.

Figure 15:
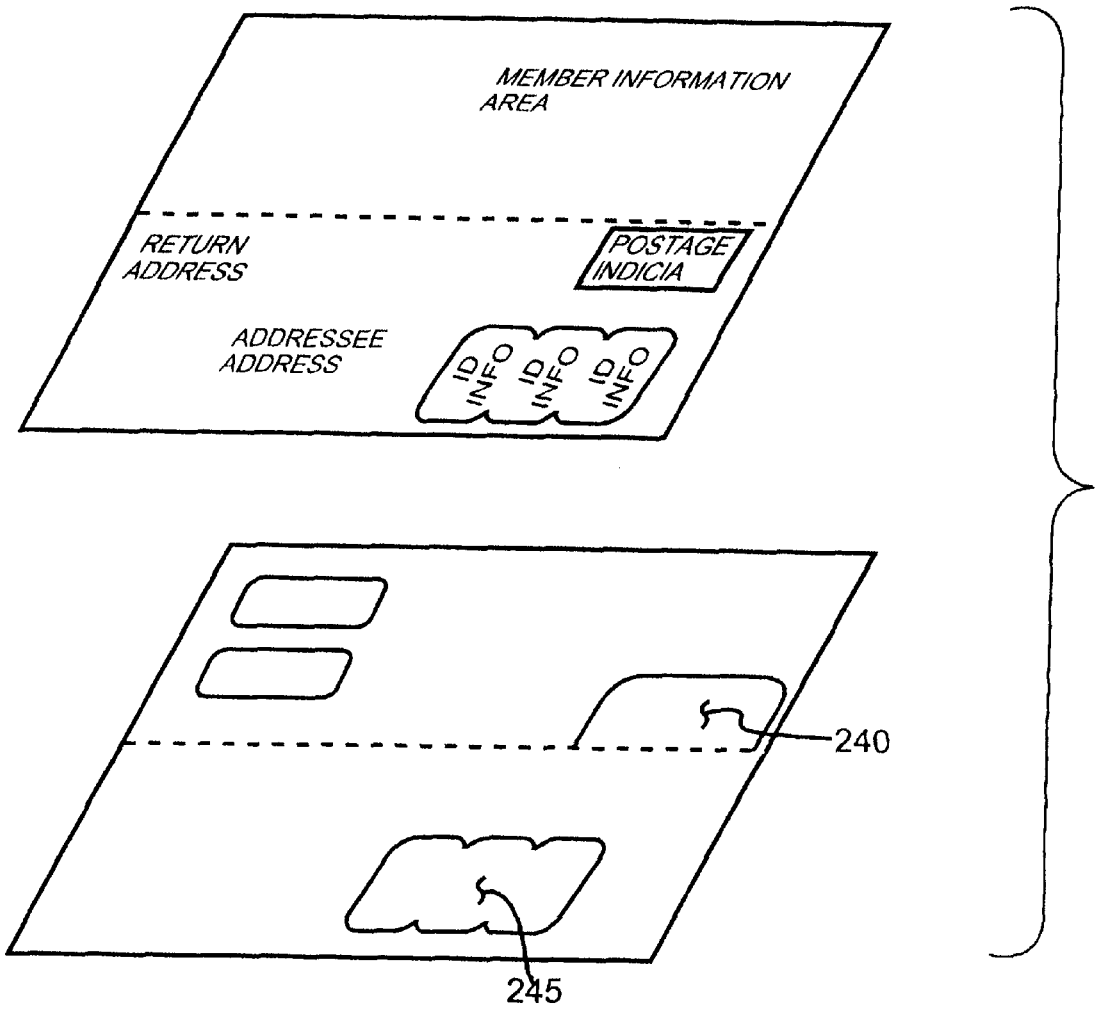
FIG. 15 shows a two-ply mailer blank as in FIG. 14, but further comprising an identification card portion in relation to a postage indicia window and postage indicia area.

FIG. 15 shows a two-ply mailer blank as in FIG. 14, but further comprising a removable identification card portion in relation to a postage indicia window 240 and postage indicia area 241.

Compared to examples of the background art, the present invention combines a number of desirable features. The initial envelope, in which the statement is sent, the statement itself, and the return envelope are all made with portions of the mailing form itself, which is preferably the size and shape of an ordinary sheet of paper, i.e., 8½ inches wide by 11 inches long. As explained above in reference to FIGS. 5 and 6, the mailing form can be easily folded into the initial envelope for mailing without the use of a folding machine.

Furthermore, all of the necessary printing can be accomplished with a single pass of the form through a non-impact printer, printing on one side of the paper. Therefore, any or all of the information printed on the form can be variable information, which is customized to the individual statement being sent. Thus, both the address of the customer and the address of the company, on both the initial envelope and on the return envelope, can be varied. Different post office boxes can be used to route the return envelopes according to the desires of the organization. A single organization can handle billing procedures for a number of different organizations. On the other hand, fixed data, such as opening instructions, can be printed on any surface of mailing form 10 by another printing process.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

What is claimed is:

1. A mailing form comprising:

a lower sheet having first and second ends and a first transverse folding line between said first and second ends;

an upper sheet overlying and aligned with said lower sheet, said upper sheet including a first upper sheet portion, an outer strip, and an inner flap, said outer strip and said inner flap being separated by a first perforation line, and outer strip extending in a "U" shape covering said second adhesive system to said second end of said lower sheet;

a first adhesive system forming a bond between said first end and an adjacent surface of said upper sheet portion, said first adhesive system extending adjacent to said first edge and adjacent to longitudinal edges of said lower sheet toward said first transverse folding line from said first edge;

a second adhesive system forming a releasable bond between said second end and said outer strip, said second adhesive system including an adhesive permanently bonded to said lower sheet, and said second adhesive system forming a permanent bond with another sheet of material after separation from said outer strip.

2. The mailing form of claim 1, wherein said second adhesive system includes a release agent coated on a face of said upper or lower sheet; and a plurality of dots of pressure sensitive adhesive, permanently bonded to an opposing upper or lower sheet, extending in a spaced apart relationship in contact with said release agent.

3. The mailing form of claim 1, wherein a transverse width of said inner flap is less than a transverse distance between portions of said first adhesive system extending adjacent to said longitudinal edges of said lower sheet of material.

4. The mailing form of claim 1, wherein the second adhesive system comprises alternating adhesive and adhesive release material disposed on an inner face of opposing upper and lower sheets.

5. The mailing form of claim 1, wherein said second adhesive system is disposed on a transparent sheet, said transparent sheet forming windows for viewing addressee address, return address, and postal indicia printed on the inner flap.

6. The mailing form of claim 5, wherein said transparent sheet further reinforces a transverse perforation formed in the form.

7. The mailing form of claim 1, wherein said outer flap extends in a "U" shape and covers said second adhesive system.

8. The mailing form of claim 1, wherein said inner flap comprises an inner flap comprises a postal indicia portion foldably positionable in alignment with a top edge of the lower sheet to place a Face Identification Mark less than one-eighth inch from said top edge.

9. The mailing form of claim 5, wherein said transparent sheet extends past a top edge of the form to be folded over to contact an outer face of the lower sheet to reinforce said top edge.

10. The mailing form of claim 5, wherein said transparent sheet forms a releasable strip overlying an adhesive material.

11. The mailing form of claim 9, wherein said inner flap is separated from said first upper sheet portion by a second perforated line; and wherein a third perforated line extends across said inner flap, dividing said inner flap into a first flap portion extending between said second and third perforated lines, and a second flap portion extending between said third perforated line and said first perforated line.

12. The mailing form of claim 11, wherein said postal indicia portion formed in said inner flap is formed by a longitudinal die-cut.

13. The mailing form of claim 12, wherein said inner flap includes a first address printed on an outer surface thereof, in an address field aligning with said address aperture when said inner flap is folded against said first upper sheet portion along with second perforated line, when said second flap portion is folded against said first flap portion along said third perforated line, and when said lower sheet is folded along said first transverse folding line around said inner flap.

14. The mailing form of claim 13, wherein said lower sheet of material additionally includes a return address aperture adjacent to said inner flap, and wherein said inner flap includes a first return address printed on an outer surface thereof, in a return address field aligning with said return address aperture when said inner flap is folded against said first upper sheet portion along said second perforated line, when said second flap portion is folded against said first flap portion along said third perforated line, and when said lower sheet is folded along said first transverse folding line around said inner flap.

15. The mailing form of claim 14, wherein said first upper sheet portion includes a second address and a second return address printed on an outer surface thereof.

16. The mailing form of claim 1, wherein said lower sheet includes into a first lower sheet portion and a second lower sheet portion, said first and second lower sheet portions being separated by a second perforated line, said first lower sheet portion being adhesively attached to said first upper sheet portion; and wherein said mailing form comprises additionally means for sealing an opening of a pocket formed by said first upper sheet portion and said first lower sheet portion.

17. The mailing form of claim 16, wherein said means for sealing includes a sealing flap foldable over said opening, with said sealing flap including a layer of adhesive.

18. The mailing form of claim 17, wherein said adhesive is covered by a removable protective strip for preventing damage to the adhesive prior to use.

19. The mailing form of claim 1, wherein said first and second ends of the upper and lower sheets include a perforation therethrough whereby said perforations align when the form is in folded configuration and forming an outgoing envelope, said aligned perforations forming a removable strip for opening the outgoing envelope.

* * * * *